United States Patent [19]

Frank

[11] 4,073,476

[45] Feb. 14, 1978

[54] OVERHEAD CRANE WITH REDUNDANT SAFETY FEATURES

[75] Inventor: Louis N. Frank, Houston, Tex.

[73] Assignee: Kranco, Inc., Houston, Tex.

[21] Appl. No.: 689,041

[22] Filed: May 24, 1976

[51] Int. Cl.[2] ..... B66D 1/26

[52] U.S. Cl. ..... 254/184; 254/188

[58] Field of Search ..... 254/183, 184, 144, 139, 254/188, 168, 192, 145, 135 CE, 139 R, 190 B, 185 R; 212/11, 14; 187/96

[56] References Cited

U.S. PATENT DOCUMENTS

| | | | |
|---|---|---|---|
| 880,566 | 3/1908 | Paige | 254/144 |
| 2,306,055 | 12/1942 | Harry | 212/11 |
| 2,370,834 | 3/1945 | Ball | 254/184 |
| 2,994,513 | 8/1961 | Bowerman et al. | 254/188 |
| 3,531,088 | 9/1970 | Kraschnewski | 254/184 |
| 3,786,935 | 1/1974 | Vlazny et al. | 254/184 |

*Primary Examiner*—Trygve M. Blix
*Assistant Examiner*—Kenneth Noland
*Attorney, Agent, or Firm*—Arnold, White & Durkee

[57] ABSTRACT

An overhead crane with redundant safety features is shown which utilizes two independently reeved hoisting systems and a dual element hook, whereby if one of the elements of the hook or one of the hoisting systems were to encounter a failure, the load being supported by the crane would remain safely supported above the ground.

23 Claims, 7 Drawing Figures

253
195
136
196
135
197
134
198
61
133
182
183
132
184
131
166
185
211
251
150
155
151
210
167
186
152
187
130
62
129
188
128
189
252
180
199
250
200
127
201
126
125
202
181

OVERHEAD CRANE WITH REDUNDANT SAFETY FEATURES

BACKGROUND OF THE INVENTION

1. Field of the Invention

The invention relates to an overhead crane having a variable lifting capacity and redundant safety features, wherein the crane utilizes two independently reeved hoisting systems including a dual element hook to achieve its variable lifting capacity and redundant safety features. The invention disclosed is particularly useful in the environment of a nuclear power plant.

2. Description of the Prior Art

There are many overhead crane applications wherein the crane's safety factor, when supporting a load, is of utmost importance. One of the most common examples is the cranes utilized in steel mills. In that environment, heavy loads consisting of ladles filed with molten metal are supported by an overhead crane. Accordingly, the prior art cranes have painstakingly sought to prevent such loads from falling to the ground, should a portion or element of the overhead crane suffer a failure.

Examples of such prior art overhead cranes and their proposed solutions may be found in U.S. Pat. Nos. 1,148,323, issued to E. H. Kendall, on July 27, 1915; 1,181,155, issued to W. H. Morgan, on May 2, 1916; 2,370,834, issued to H. W. Ball, on Mar. 6, 1945; and 1,202,533, issued to D. Kendall, on Oct. 24, 1916; 2,271,427, issued to R. J. Harry, on Jan. 27, 1942; and 2,271,430, issued to R. J. Harry, on Jan. 27, 1942.

Each of the foregoing prior art patents utilize two hoist drums for supporting a load beneath the overhead crane. Additionally, these patents all utilize some form of gearing arrangement, whereby a failure associated with one hoist drum will not affect the operation of the other hoist drum. However, some of these prior art cranes; e.g., U.S. Pat. No. 1,181,155 and 1,148,323, utilize intermeshing gears disposed directly on the hoist drums. Accordingly, if a failure associated with one of the hoist drums were to occur, its failure would preclude the other hoist drum from rotating. Although the suspended load would not be dropped to the ground, the load would remain suspended in the air until such time as the broken hoist drum could be repaired. In the case of a steel mill, this could present a substantial problem, since the molten metal could solidify in the ladle, plus the attendant loss of time in having to stop utilizing that particular crane while it is being repaired.

The other patents previously referred to, while overcoming the problem associated with hoist drums having direct intermeshing gears, still do not provide a satisfactory solution to problems associated with either a hook or cable breaking. Although these patents provide a safety factor with respect to a single broken gear or hoist drum, there is no safety factor present if more than one gear or shaft should fail. Additionally, were the hooks suspended from these cranes to encounter any type of failure, the load suspended by that hook would fall to the ground.

In some overhead crane applications, a safety factor or safety feature which prevents the load being suspended from falling to the ground in the event of a single failure of some component of the crane may be sufficient. However, there are certain overhead crane applications wherein it is desirable and necessary to have safety factors, or safety features, which are redundant, whereby the load is prevented from falling to the ground if one or more of the elements of the overhead crane should fail.

One example of such an environment may be found in overhead cranes which are utilized in nuclear power plants, wherein such cranes are utilized for lifting and supporting radioactive nuclear materials above the floor of the nuclear power plant. Additionally, in such an environment, it is not desirable to merely prevent such a radioactive load from falling to the floor. Rather, it is extremely desirable to be able to either continue to lift or lower the radioactive load into its desired position, and not merely leave the load suspended while the crane is being repaired. Another factor to be taken into consideration in such an operating environment is that the overhead crane should likewise have a multiple safety factor, or safety features, associated with the lifting hook and its related cables, whereby if the hook or an associated cable should experience a failure, it will be possible to continue to raise or lower the radioactive load.

One proposed solution to such problems as are encountered in a nuclear power plant may be found in U.S. Pat. No. 3,786,935, issued to Joseph J. Vlazny et al., issued Jan. 22, 1974. Although this patent discloses an overhead crane which utilizes a "redundant or double load path crane hook" the crane hook is mounted upon a single load block. Thus, were a failure to occur affecting the load block structure, the intended purpose and safety features associated with the "redundant crane hook" would be useless and the suspended load would fall to the floor. Additionally, the suggested solution in this patent to achieve additional safety features is lacking in other respects. Since only one hoist drum is utilized, the crane will not function to raise or lower the radioactive load, if that hoist drum becomes disabled. Another problem could occur in the event the equalizer bar utilized by Vlazny encountered a failure. If that failure occurred, in all likelihood the suspended load would fall to the floor of the nuclear power plant. Whereas this patent provides a safety factor of one if a cable were to break; if both cables break, the load would naturally fall to the floor. Additionally, since all the sheaves in this disclosed crane do not rotate about parallel axes, the cables by which the load is suspended are subjected to unnecessary, additional torsional stresses which, it is believed, may affect the operating life of the cables.

Another factor to consider in utilizing an overhead crane in the environment of a nuclear power plant, or other large facility, is that such a crane is frequently utilized, not only in the operation of the ultimate plant, but the crane is also utilized to lift and lower other types of loads while the plant is being constructed. Normally, the loads encountered during the construction phase are of a larger magnitude than the loads encountered during plant operation. Accordingly, it is desirable to have an overhead crane which, in addition to having redundant safety features, also has a variable lifting capacity. U.S. Pat. No. 3,854,892, issued to Sigurd C. Mordre, on Dec. 17, 1974, is one example of an overhead crane which seeks to provide this variable lifting capacity. Basically, the crane disclosed in this patent utilizes a secondary trailer trolley. Although this crane does have a variable lifting capacity, there has been very little attempt made to provide this crane with adequate safety features, whereby this crane could be utilized in a nuclear power plant. For example, this crane could not withstand any failure occurring to its hook without the attendant result of the load falling to the floor of the plant. Furthermore, since only a single cable is utilized, failure of that cable would result in the suspended load falling to the ground.

Accordingly, prior to the development of the present invention, there has been no overhead crane available which provides an increased number of redundant safety features whereby an overhead crane could experience a failure occurring to more than one element of the overhead crane, and still continue to raise and lower a load suspended from the crane. Therefore, the art has sought an extremely safe overhead crane, suitable for use in the environment of a nuclear power plant, which crane possesses many redundant safety features.

SUMMARY OF THE INVENTION

The overhead crane according to the present invention has a greater number of redundant safety features than the overhead cranes of the prior art, and the present invention additionally provides a variable lifting capacity. These advantages are realized by the utilization of two independent sheave systems and a dual element hook.

In its broadest aspects the overhead crane of the present invention comprises a frame and a hook assembly which is extendable and retractable through a plurality of sheave assemblies, and is provided with the following improvement. A dual element hook which is adapted to support a load and two independently reeved hoisting systems are utilized. Each hoisting system engages one element of the dual hook and each system is capable of supporting and lifting a first load on the hook. The hoisting systems are adapted to operate in unison to provide redundant safety features when supporting and lifting the first load, and, additionally, to support and lift a second load which is greater than the first load. Each independent hoisting system is comprised of an upper sheave assembly, which includes a plurality of sheaves, mounted on the frame of the crane; a block sheave assembly, which includes a plurality of sheaves, suspended from the frame; at least two ropes reeved on the sheaves of the upper sheave and block sheave assemblies; a take-up means for extending and retracting the ropes, with one of the ends of each rope attached to the take-up means; and an equalizer bar.

A hoist drum which has ropes wound thereon with one end of each of the ropes attached to the drum may be utilized as the take-up means. Additionally, a first drum rotation assembly is associated with both of the independent take-up means, and this drum rotation assembly is comprised of a first brake, a first hoist gearbox and a first drum gearbox. A further feature is that a second drum rotation assembly may be associated with both of the take-up means. This second drum rotation assembly is comprised of a second brake, a second hoist gearbox, and a second drum gearbox. Each drum gearbox has power transmitted to it from its associated gearbox, and the gearbox is provided with means for rotating the hoist drums simultaneously or independently of one another, whereby if one of the drums becomes inoperative, the other drum will be rotated by one of the gear boxes. Thus, if one drum rotation assembly becomes inoperative the other drum rotation assembly will rotate the hoist drums.

Another feature of the present invention is the utilization of a dual element hook comprised of a first and second hook means, each hook means having a shaft mounted on it, and each shaft being fixedly secured to one of the independent sheave systems. Additionally, the longitudinal axes of these two shafts coincide with one another. In a preferred embodiment, one of the hook means is comprised of a lifting eye and the other hook means is comprised of a sister hook.

Additionally, the dual element hook may be provided with means for connecting the first and second hook means, wherein a sister hook extension means is associated with the sister hook and a connection member is used for connecting the sister hook extension means and the lifting eye. Preferably, the sister hook extension means is comprised of two plate members which are fixedly secured to the sister hook, thus forming a space between the two plate members, and the connection member is comprised of a bushing. The lifting eye is disposed below the sister hook in the space between the two plate members and the bushing passes through the two plate members and the lifting eye.

In more specific terms, the overhead crane of the present invention comprises: a frame; two substantially axially parallel hoist drums mounted on the frame, each drum having two separate ropes wound thereon with one end of each rope attached to its respective drum; means for rotating said drums; an upper sheave assembly mounted on the frame and associated with both of the drums; a lower load block assembly suspended from the frame, which includes an upper block sheave assembly associated with one of the drums and a lower block sheave assembly associated with the other drum, the upper and lower sheave assemblies being independent of each other; an equalizer bar assembly mounted on the frame and having the other ends of the ropes attached to the equalizer bar assembly; a hook assembly, associated with the lower load block assembly, which includes a lower hook assembly associated with said lower block sheave assembly and an upper hook assembly associated with said upper block sheave assembly, each of the upper and lower hook assemblies capable of independently supporting a weight equal to a plant lifting capacity; and means for connecting the upper and lower hook assemblies to provide the crane with a redundant lifting capacity and a construction lifting capacity in excess of the plant lifting capacity, whereby when the crane is supported a weight equal to the plant lifting capacity, a failure one of the hook assemblies will be overcome by the other hook assembly and the weight will remain supported.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
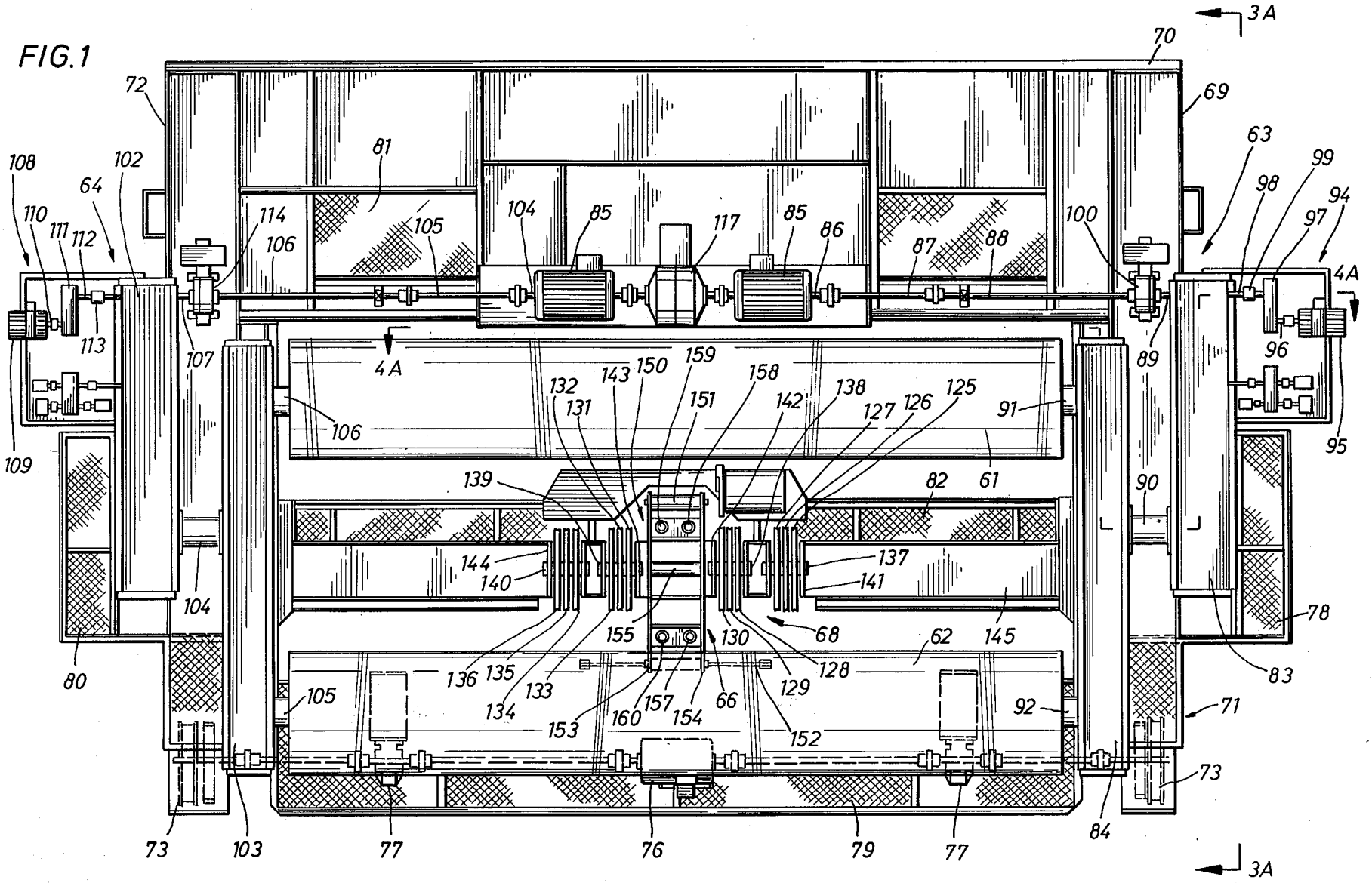
FIG. 1 is a top view of an overhead crane constructed in accordance with the present invention.
Figures 3A, 3B:
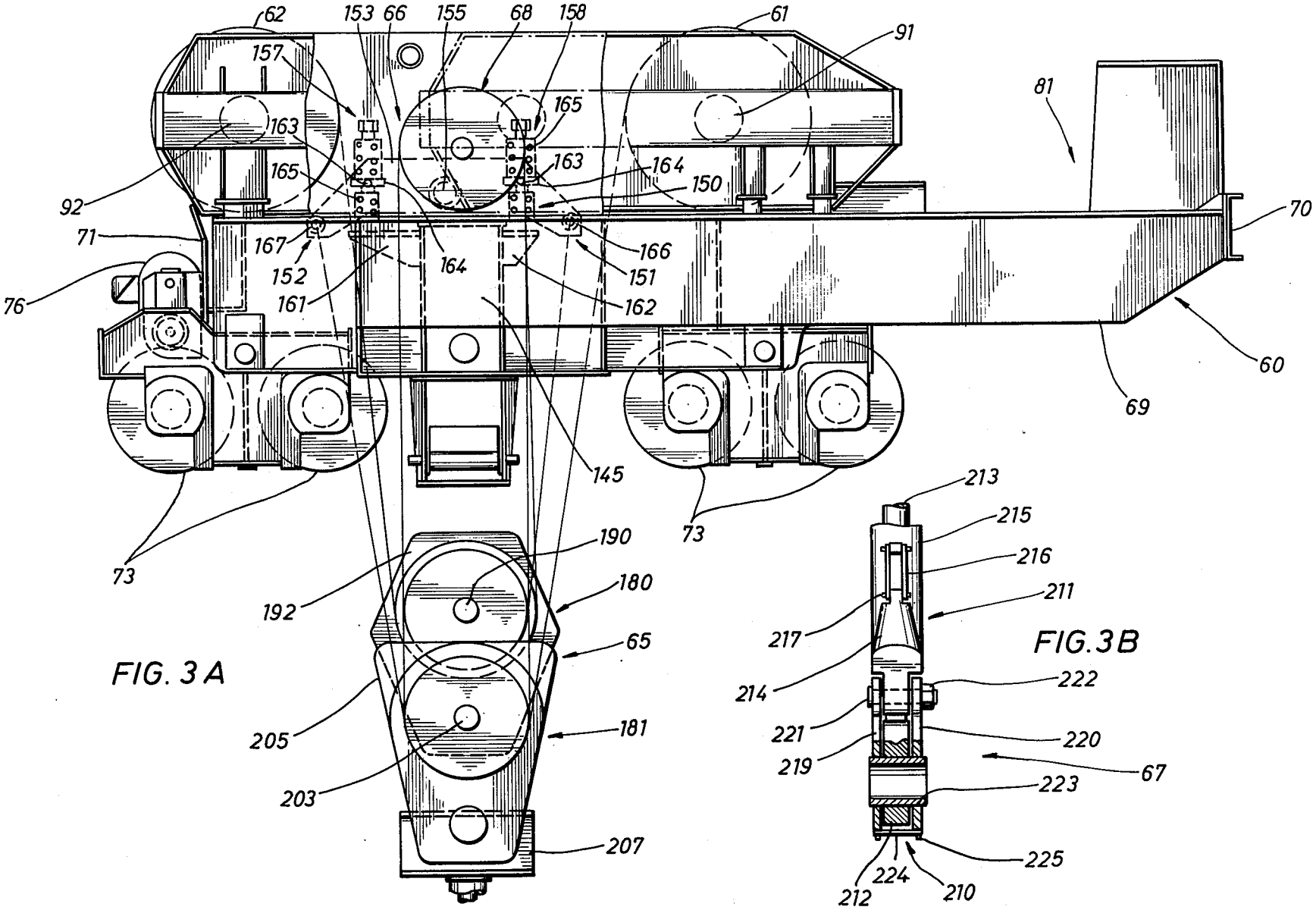
FIG. 3A is a side view of an overhead crane according to the present invention taken along line 3A—3A of FIG. 1.
FIG. 3B is a side view of a dual element hook, or hook assembly, in accordance with the present invention (the hook having been separated from the lower portion of FIG. 3A for ease of illustration)
Figures 4A, 4B:
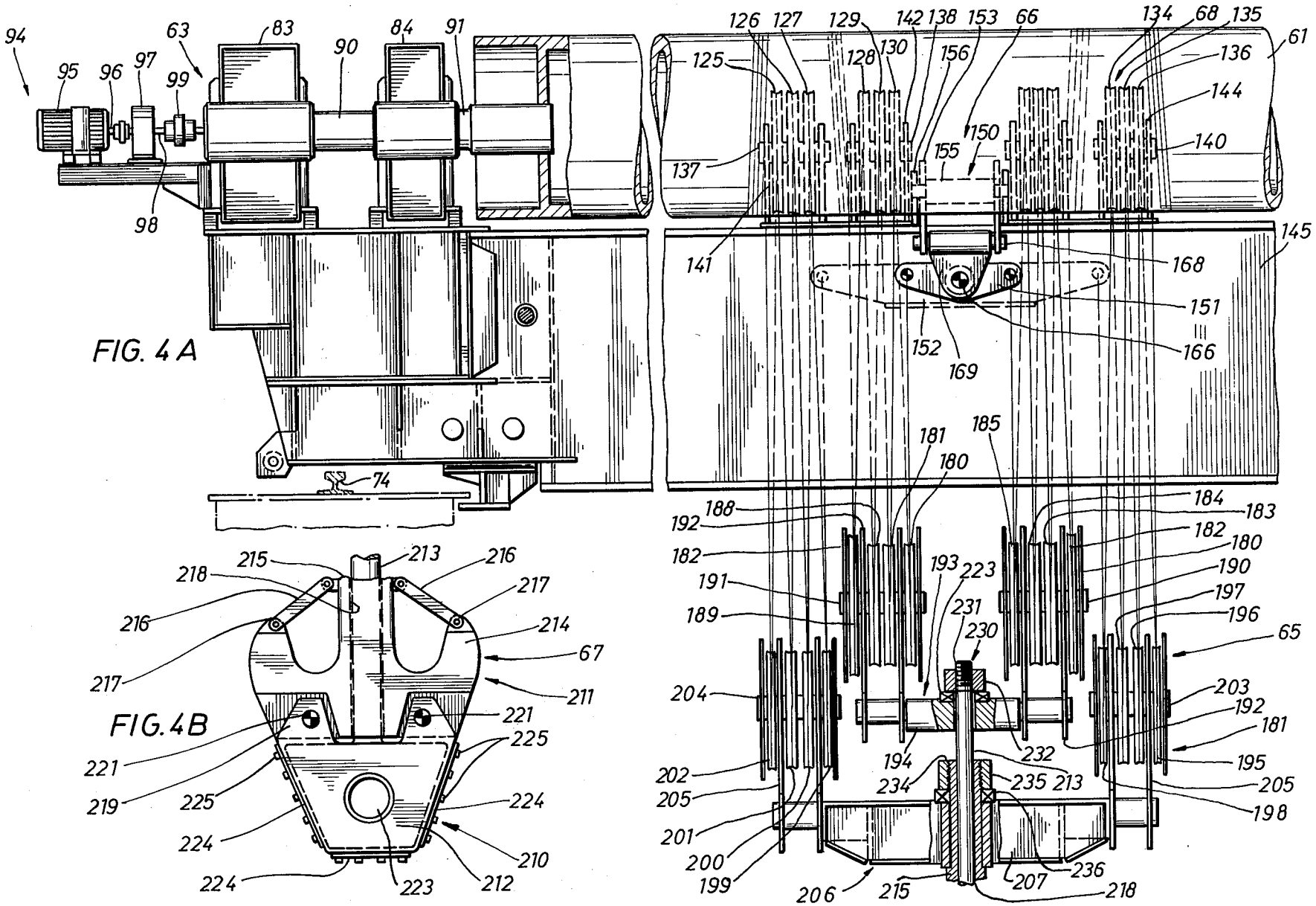
FIG. 4A is a partial cross sectional view taken along line 4A—4A of FIG. 1.
FIG. 4B is a front view of a dual hook member, or hook assembly, in accordance with the present invention (the hook having been separated from the lower portion of FIG. 4A for ease of illustration)

Turning first to FIGS. 1 and 3A, the general configuration of the various elements in an overhead crane having redundant safety features and a variable lifting capacity, which achieves the advantages previously described, is shown as comprising: a frame 60; a take-up means, or hoist drums, 61 and 62; a means for rotating the drums generally shown at 63 and 64; a lower load block assembly 65; an equalizer bar assembly 66; a dual element hook, or hook assembly, 67, shown generally in FIGS. 3B and 4B; and upper sheave assembly 68.

Figure 2:
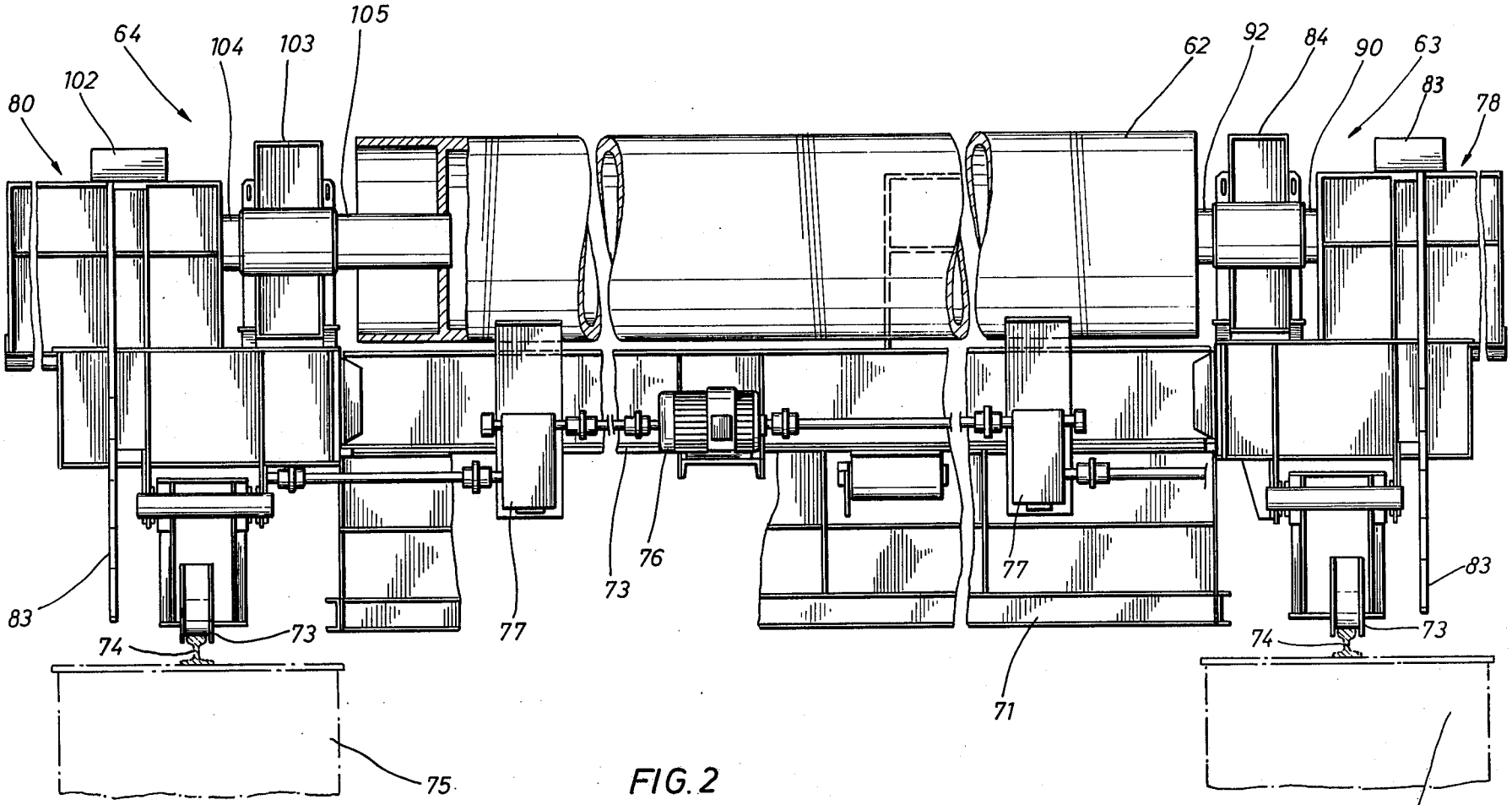
FIG. 2 is a front view of the crane of FIG. 1.

Frame 60 is of conventional design and may be comprised of four steel beams 69, 70, 71 and 72, having a generally rectangular configuration. It is, of course, to be understood that any suitable configuration or material could be used in constructing frame 60. Frame 60 is mounted upon a plurality of wheels 73 which are adapted for rolling movement along overhead tracks 74 and are mounted on an overhead rail system 75 as shown and are mounted on an overhead rail system 75 as shown in FIG. 2. Wheels 73, tracks 74, and rails 75 are of conventional design.

Referring now to FIGS. 1, 2, and 3A, it will be seen that frame 60 is provided with a suitable motor 76 and gearing arrangement 77 of conventional design for providing rotational movement to wheels 73. Motor 76 is provided with suitable, conventional operating controls for starting and stopping the movement of frame 60 along tracks 74.

Referring now to FIGS. 1 and 2 it will be seen that frame 60 may be provided with a plurality of conventional catwalks 78, 79, 80, 81, and 82. Additionally, two ladders 83 as shown in FIG. 2, are provided for easy access to the catwalks 78 and 80 from overhead rails 75.

Turning now to FIGS. 1 and 4A, the means for rotating hoist drums 61 and 62, or drum rotation assemblies 63 and 64 will be described. The first drum rotation assembly 63 is mounted upon frame 60 and is comprised of a first hoist gearbox 83 and a first drum gearbox 84. A power source 85 is provided for supplying rotational movement to gearboxes 83 and 84. A plurality of shafts 86, 87, 88 and 89 connect power source 85 to the hoist gearbox 83. Hoist gearbox 83, in turn, transmits power to drum gearbox 84 via shaft 90. Drum gearbox 84, in turn, rotates drums 61 and 62 via shafts 91 and 92. Disposed within drum gearbox 84 are a plurality of idler gears (not shown) whereby if one of the drums 61 or 62 becomes inoperative, the other operating drum will continue to be rotated by gearbox 84. In other words, because of the idler gear arrangement within drum gearbox 84. power may be selectively applied to either drum 61 or 62, or to both drums 61 and 62 simultaneously. Any suitable gearboxes may be utilized for hoist gearbox 83 and drum gearbox 84, which will achieve the desired independent, or simultaneous, rotational movement of drums 61 and 62.

Still referring to FIGS. 1 and 4A, it will be seen that hoist gearbox 83 is also provided with an auxiliary microdrive unit, shown generally at 94. Microdrive unit 94 is comprised of an electric motor 95, shaft 96, gearbox 97, shaft 98, and an electric clutch 99. The first drum rotation assembly 63 is also provided with an electric brake 100, whereby a braking force may be applied. By engagement of clutch 99, microdrive unit 94 transmits power to hoist gearbox 83. Microdrive unit 94 enables precise movement of drums 61 and 62 to occur, whereby a load may be precisely lifted and lowered any desired amount. Suitable controls, not shown, are provided for operating microdrive unit 94, clutch 99 and brake 100, such controls being well within the skill of the art.

A second drum rotation assembly 64 is also mounted on frame 60 and is associated with the ends of the drums 61 and 62, which are opposite to the ends which the first drum rotation assembly 63 is associated. The second drum rotation assembly 64 is identical to the first drum rotation assembly 63. Accordingly, drum rotation assembly 64 comprises a second hoist gearbox 102, a second drum gearbox 103, and shafts 104, 105, 106 and 107 connecting the power source 85 to hoist gearbox 102. Likewise, gearbox 103 receives power from hoist gearbox 102, and, in turn, transmits a rotational movement to drums 61 and 62 via shafts 105 and 106. The second drum gearbox 103 is also provided with a suitable idler gear arrangement, whereby drums 61 and 62 may be rotated simultaneously or independently of one another. Independent rotation of either drum 61 or 62 is provided if in the event one of the drums 61 or 62 becomes inoperative, whereby drum gearbox 103 will continue to rotate the operating drum in order to safely raise or lower a load which is suspended beneath frame 60.

The second drum rotation assembly is also provided with a second microdrive unit 108 which is identical to microdrive unit 94. Microdrive unit is comprised of an electric motor 109, shaft 110, gearbox 111, shaft 112 and clutch 113. Additionally, drum rotation assembly 64 is provided with an electric brake 114, whereby a braking force may be applied.

Power source 85 is comprised of two electric motors. It should be readily apparent that one sufficiently large motor 85 could readily be utilized. The utilization of an electric motor for power source 85 is preferable; however, it should be readily apparent that other power sources, e.g., hydraulic motors or internal combustion engines, may be utilized. Disposed between motors 85 is an electric control brake 117, which serves to provide a common braking force upon either drum rotation assembly 63 or 64.

Another feature of the drum rotation assembly 63 and 64 is that the utilization of a separate brake 114 and 100 with each drum rotation assembly provides at least two brakes capable of exerting a braking force upon the drum rotation assembly 63 and 64. For example, even if shaft 186 were to experience a failure, both brake 114 and 100 would still continue to operate. Since motors 85 would be providing a rotational force to gearboxes 83 and 73, brake 100 would be able to exert its braking force upon gearbox 83. At the same time, due to the rotation of drums 61 and 62, a rotational force will be transmitted through gearboxes 103 and 102. Since shaft 107 would be rotating in response to the rotation of gearbox 102, brake 114 would still be able to exert a braking force upon drum rotation assembly 64. Thus, another redundant safety feature is provided, wherein both brakes 100 and 114 can apply a braking force.

A suitable, conventional control system (not shown) is provided for operating and controlling drum rotation assemblies 63 and 64 such control system being within the skill of the art.

Referring to FIG. 1, it will thus be seen that there is provided a system having redundant safety features for rotating the take-up means, or drums 61 and 62. Under ideal operating conditions, both drum rotation assemblies 63 and 64 will serve to provide drums 61 and 62 with rotational movement. However, if in the event of a failure of one of the elements of either drum rotation assembly 63 or 64, the redundant drum rotation system 63 and 64 will enable the continued operation of the crame. For example, if either drum 61 or 62 were to become inoperative, it would still be possible to utilize hoist gearboxes 102 and 83 to supply a rotational movement to drum gearboxes 103 and 84, which, in turn, would continue to supply rotational movement to the remaining operating drum. With the previously described system, it is also possible, for example, to rotate drum 61 via drum gearbox 84 and hoist gearbox 83; and to rotate drum 62 via drum gearbox 103 and hoist gearbox 102. This situation could arise if the portions of drum gearboxes 103 and 84 associated with a particular drum were to become inoperative. Even if the power source 85 were to become inoperative, the drums 61 and 62 could still be rotated by microdrive units 94 and 108, thus providing an additional measure of safety.

Turning now to FIGS. 1 and 4A, the upper sheave assembly 68 of the present invention will be described. Upper sheave assembly 68 is comprised of a plurality of sheaves 125–136 mounted on shafts 137–140. Shafts 137–140 are mounted between four brackets 141–144, which are mounted upon load girt 145. Load girt 145 is comprised of a large structural member, or beam, which is disposed between frame members 69 and 72, whereby load girt 145 additionally comprises a portion of frame 60.

Referring now to FIGS. 1, 3A, and 4A the equalizer bar assembly 66 of the present invention will be described. The equalizer bar assembly is comprised of a common equalizer bar generally shown as 150, a first equalizer bar 151 pivotably mounted to one end of the common equalizer bar 150, and a second equalizer bar 152 pivotably mounted to the other end of the common equalizer bar 150. The common equalizer bar 150 is comprised of two plate members 153 and 154 which are pivotably mounted about shaft 155 which is supported in a bracket 156 upon load girt 145. Thus, common equalizer bar 150 is pivotably mounted about an axis which is substantially parallel to the longitudinal axes of hoist drums 61 and 62. Whereas the common equalizer bar 150 is shown as comprising two plate members 153 and 154, it should be readily apparent that it could likewise be comprised of a single beam pivotably mounted about shaft 155. Common equalizer bar 150 is further provided with shock dampening means 157–160 which are mounted upon load girt 145 via mounting brackets 161 and 162. Shock dampening members 157–160 are provided with shafts 163 which engage slots 164 in common equalizer bar 150, as best seen in FIG. 3A. Shockdampener means 157–160 may be of standard construction and may utilize either springs, a hydraulic piston, etc. In the preferred embodiment of the present invention, springs 165 are utilized to dampen any shock forces sustained by the common equalizer bar 150.

Referring now to FIGS. 1 and 4A it will be seen that the first equalizer bar 151 is pivotably mounted via shaft 166 to one end of the common equalizer bar 150. The second equalizer bar is pivotably mounted about shaft 167 at the other end of the common equalizer bar 150. Shafts 166 and 167 are supported between plates 153 and 154 by shafts 168 and a suitable mounting bracket 169, as shown in FIG. 4A. Thus, the first and second equalizer bars 151 and 152 are pivotably mounted at opposite ends of the common equalizer bar 150, for rotation about an axis which is substantially perpendicular to the longitudinal axis of the hoist drums 61 and 62.

Referring now to FIGS. 3A and 4A, the lower load block assembly 65 will be described. Lower load block assembly 65 is comprised of an upper block sheave assembly generally designated 180 and a lower block sheave assembly generally designated 181. Upper block sheave assembly 180 is comprised of a plurality of sheaves 182–189, sheaves 182–185 being mounted upon shaft 190 and sheaves 186–189 being mounted upon shaft 191. Shafts 190 and 191 are mounted on suitable brackets 192 which are fixedly secured to member 193. Member 193 may preferably be comprised of a beam 194.

Lower block sheave assembly 181 is comprised of a plurality of sheaves 195–202 which are similarly mounted upon shafts 203 and 204. Shafts 203 and 204 are likewise mounted within brackets 205 which are fixedly secured to member 206 which may be comprised of a beam 207.

Referring now to FIGS. 3B and 4B the dual element hook, or hook assembly, 67 of the present invention will be described. Hook assembly 67 is comprised of an upper hook assembly generally designated 210 and a lower hook assembly generally designated 211. Upper hook assembly 210 is comprised of a first hook means 212 having a first shaft 213 mounted on it. The lower hook assembly 211 is comprised of a second hook means 214 having a second shaft 215 mounted on said second hook 214. Preferably, hook means 214 is comprised of a sister hook, whereas means 212 is comprised of a lifting eye. Preferably, shafts 213 and 215 are integrally formed with their respective hooks 212 and 124; however, it should be readily apparent that the shafts 213 and 215 could be fixedly secured by other means, such as welding. Sister hook 214 is additionally provided with two safety latches 216 for providing an additional safeguard to prevent a load from sliding off the sister hook 214. Suitable releasable pins 217 are provided for opening and closing safety latches 216.

Still referring to 3B and 4B, it will be seen that shaft 215 has a passageway extending throughout its longitudinal axis, whereby shaft 213 loosely fits within this passageway 218. Accordingly, the longitudinal axis of shaft 213 coincides with the longitudinal axis of shaft 215.

Sister hook 214 is additionally provided with a means for connecting hooks 214 and 212. This connection means is comprised of a sister hook extension means which is associated with the sister hook 214 and a connection member for connecting the sister hook extension means and lifting eye 212. Preferably, sister hook extension means is comprised of two plate members 219 and 220 which are fixedly secured to the sister hook 214 by means of two nuts and bolts 221 and 222. The connection member preferably utilized for connecting the sister hook extension means 219 and 220 is comprised of a bushing 223 which passes through plates 219 and 220 and lifting eye 212. Additional plate members 224 and associated screws 225 may be utilized for securing plates 219 and 220 together.

Referring now to FIGS. 4A and 4B, it is seen that shaft 213 of the upper hook assembly 210 passes through passageway 218 and is fixedly secured to the upper block sheave assembly 180 by means of a threaded connection 230. Shaft 213 is threaded at its upper end 231 and this threaded portion engages a nut 232 which bears upon a conventional thrust bearing 233, which in turn abuts against member 193 of the upper block sheave assembly 180. The upper portion of shaft 215 is likewise threaded at 234 and this threaded portion 234 is engaged by nut 235. Nut 235 in turn abuts against thrust bearing 236 which bears against member 206 of the lower block sheave assembly 181.

It should be readily apparent that other connection means other than threaded portions 231 and 234 and nuts 232 and 235 could be utilized for attaching shafts 213 and 215 to the upper and lower block sheave assemblies respectively. Likewise, it should also be readily apparent that, although a two pronged sister hook 214 and lifting eye 212 are disclosed as preferable for use as the upper and lower hooks 212 and 214, other configurations of hooks could be readily adapted for use in the present invention. For example, hook 214 could be comprised of a four pronged hook and lifting eye 212 could likewise be in the configuration of a sister hook, so long as provision is made for passage of bushing 223 through whatever hook configuration is used for hook 212 and that the axes of the shafts associated with each hook have their longitudinal axes coincide.

Figure 5:
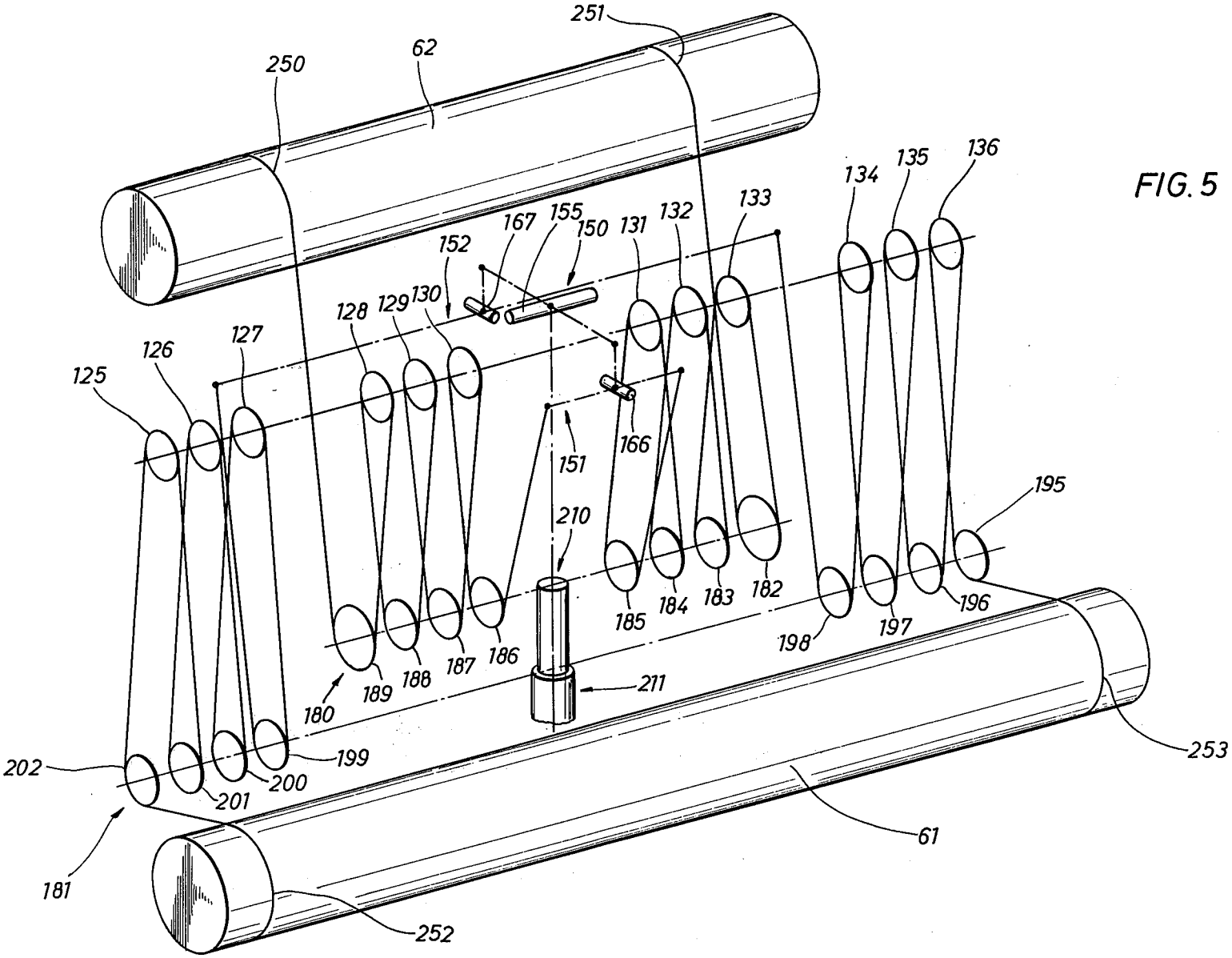
FIG. 5 is an isometric view of a schematic view reeving diagram in accordance with the present invention.

The specific elements of the overhead crane of the present invention having been previously described, the overall operation of the crane will now be described in reference to the schematic reeving diagram of FIG. 5. Each take-up means or hoist drum 61 and 62 has at least two ropes wound thereon with one end of each of the ropes attached to the drum. It should be readily apparent that the use of the word "rope" encompasses not only ropes, but any type of cable, e.g., steel cables, nylon cables, other metallic cables, etc. Drum 62 has ropes 250 and 251 wound onto drum 62 with one end of each rope 250 and 251 attached to the drum. Likewise drum 61 has ropes 252 and 253 wound thereon, with one end of each of the ropes 252 and 253 attached to drum 61. Looking first at ropes 250 and 251, it is seen that these ropes 250 and 251 are reeved onto the sheaves of the upper lock assembly 180 and over the sheaves 128–133 of the upper sheave assembly, with the ends of ropes 250 and 251 being attached to the first equalizer bar 151. Specifically rope 250 is associated with sheaves 186–189 of the upper block sheave assembly and sheaves 128–130 of the upper sheave assembly. Likewise, rope 251 is associated with sheaves 182–185 of the upper block sheave assembly and sheaves 131–133 of the upper sheave assembly. The sheaves of the upper block assembly 180, or block sheaves 182–189, are associated with, and engage, the upper hook assembly 210 of the dual element hook 67 as previously described. Thus, it can be seen that drum 62; upper block sheave assembly 180; sheaves 128–133 of the upper sheave assembly, which constitute an independent upper sheave assembly; ropes 250 and 251; and the first equalizer bar assembly 151 constitute a complete independently reeved hoisting system which engages as element of the dual element hook 67, namely upper hook assembly 210.

Another independently reeved hoisting system is comprised of drum 61; ropes 252 and 253; lower block sheave assembly 181, which includes sheaves 195–202; and the upper sheave assembly comprised of sheaves 125–127 and 134–136 of the upper sheave assembly, the ends of ropes 252 and 253 being attached to the second equalizer bar assembly 152. This independently reeved hoisting system also engages one element of the dual element hook 67, or lower hook assembly 211 as discussed previously.

Additionally, these independently reeved hoisting systems each include their own independent drum rotation assemblies 63 and 64. Accordingly, it can be readily seen that a load suspended by lower hook assembly 211, or sister hook 214 is being supported by two independently reeved hoisting systems, whereby if one of the elements of either system, or if an entire system, were to encounter a failure the remaining hoisting system would continue to support and either lift or lower the load suspended from hook 214. In normal operation the load being suspended by the two independently reeved hoisting systems, which act in unison in order to provide redundant safety features, will be a load equal to the maximum weight encountered in the operation of the crane within a plant, or in other words a plant lifting capacity. Thus, when lifting a load equal to the plant lifting capacity, the crane could experience a failure associated with a complete independently reeved hoisting system and still safely operate. Additionally, were one rope of each independently reeved hoisting system to break, the overhead crane of the present invention would likewise continue to safely operate.

It should be pointed out that the common equalizer bar assembly 150 will serve to compensate for any speed of size deviations associated with drums 61 and 62, while at the same time insures that the forces acting upon the upper and lower block sheave assemblies 180 and 181 will be equalized. The first and second equalizer bars 151 and 152 serve to keep each independent lower block sheave 180 and 181 level, or parallel, with respect to the surface of the plant floor.

By utilizing the sister hook extension means 219–223, the crane of the present invention is capable of acting in unison and lifting a load which is in excess of the plant lifting capacity of the crane. This greater load may be considered to be equal to the maximum load for which the overhead crane of the present invention would be utilized for in construction the ultimate plant, or in other words a construction lifting capacity. When utilizing the crane of the present invention to raise or lower a load equal to the crane's construction lifting capacity, the crane also has redundant safety features associated with the two independent drum rotation assemblies 63 and 64, and the redundant safety features previously described.

The foregoing description of the invention has been directed in primary part to a particular preferred embodiment in accordance with the requirements of the Patent Statutes and for purposes or explanation and illustration. It will be apparent, however, to those skilled in this act that many modifications and changes in the specific apparatus may be made without departing from the scope and spirit of the invention. For example, the number of sheaves utilized in the upper sheave assembly and the lower load block assembly may be readily varied in accordance with the load which is intended to be raised and lowered by the crane of the present invention.

It is the applicant's intent in the following claims to cover such modifications and variations as fall within the true spirit and scope of the invention.

I claim:

1. An overhead crane having a variable lifting capacity and redundant safety features comprising:

(a) a frame (b) two substantially axially parallel hoist drums mounted on said frame, each drum having two separate ropes wound thereon with one end of each rope attached to its respective drum;

(c) means for rotating said drums;

(d) an upper sheave assembly mounted on said frame, associated with both of said drums;

(e) a lower block assembly suspended from said frame which includes an upper block sheave assembly associated with one of said drums and a lower block sheave assembly associated with the other drum, said upper and lower block sheave assemblies being independent of each other;

(f) an equalizer bar assembly mounted on said frame having the other ends of said ropes attached to the equalizer bar assembly;

(g) a hook assembly, associated with said lower load block assembly, which includes a lower hook assembly associated with said lower block sheave assembly and an upper hook assembly associated with said upper block sheave assembly, each of said upper and lower hook assemblies capable of independently supporting a weight equal to a plant lifting capacity; and (h) means for connecting said upper and lower hook assemblies to provide said crane with a redundant plant lifting capacity and a construction lifting capacity in excess of said plant lifting capacity, whereby when said crane is supporting a weight equal to said plant lifting capacity, a failure in one of said hook assemblies will be overcome by the other hook assembly and the weight will remain supported.

2. The crane of claim 1 wherein the means for rotating said drums comprises:

a first drum rotation assembly which includes a first brake, a first hoist gearbox, and a first drum gearbox;

the first drum rotation assembly being mounted on said frame and associated with one end of each of said drums;

the first drum gearbox having power transmitted to it from said first hoist gearbox; and the first drum gearbox being provided with means for rotating said drums simultaneously or independently of one another, whereby if one of said drums becomes inoperative, the other drum will be rotated by the first drum gearbox.

3. The crane of claim 2 wherein the means for rotating said drums further comprises:

a second drum rotation assembly which includes a second brake, a second hoist gearbox, and a second drum gearbox;

the second drum rotation assembly being mounted on said frame and is associated with the ends of said drums which are opposite to the ends which said first rotation assembly is associated;

the second drum gearbox having power transmitted to it from said second hoist gearbox; and the second drum gearbox being provided with means for rotating said drums simultaneously or independently of one another, whereby if one of said drums becomes inoperative, the other drum will be rotated by the second drum gearbox.

4. The crane of claim 3 wherein the first and second brakes are associated with said first and second hoist gearboxes.

5. The crane of claim 1 wherein said equalizer bar assembly comprises:

a common equalizer bar pivotably mounted on the frame which compensates for any rotational speed or size deviations associated with the hoist drums;

a first equalizer bar pivotably mounted to one end of said common equalizer bar and associated with the lower block sheave assembly to maintain the stability of said lower block sheave assembly;

a second equalizer bar pivotably mounted to the other end of the common equalizer bar and associated with the upper block sheave assembly to maintain the stability of said upper block sheave assembly; and the first and second equalizer bars functioning independently of one another, whereby a failure affecting one of said equalizer bars and its associated block sheave assembly does not impair the functioning of the other equalizer bar and its associated block sheave assembly.

6. The crane of claim 5 wherein the common equalizer bar is pivotably mounted about an axis which is substantially parallel to the longitudinal axis of the hoist drums and the first and second equalizer bars are pivotably mounted about an axis which is substantially perpendicular to the longitudinal axis of the hoist drums.

7. The crane of claim 1 wherein:

the upper hook assembly comprised of a first hook means having a first shaft mounted on it;

the first shaft of the upper hook assembly being fixedly secured to said upper block sheave assembly;

the lower hook assembly is comprised of a second hook means having a second shaft mounted on it;

the second shaft of the lower hook assembly being fixedly secured to said lower block sheave assembly; and the longitudinal axes of said first and second shafts coinciding with one another.

8. The crane of claim 7 wherein:

said first hook means is comprised of a lifting eye; and said second hook means is comprised of a sister hook.

9. The crane of claim 8 wherein the means for connecting the upper and lower hook assemblies comprises:

a sister hook extension means which is associated with the sister hook; and a connection member for connecting said sister hook extension means and said lifting eye.

10. The crane of claim 9 wherein:

the sister hook extension means is comprised of two plate members which are fixedly secured to the sister hook, thus forming a space between the two plate members;

the connection member is comprised of a bushing;

the lifting eye is disposed below the sister hook in the space between the two plate members; and the bushing passes through the two plate members and the lifting eye.

11. In an overhead crane comprising a frame and a hook assembly, extendable and retractable through a plurality of sheave assemblies, the improvement which comprises:

a dual element hook adapted to support plural loads;

two indenpendently reeved hoisting systems, each system independently engaging the dual element hook and each system capable of supporting and lifting a first load on said hook;

the hoisting systems being adapted to operate in unison to provide redundant safety features when supporting and lifting said first load and when supporting and lifting a second load which is greater than said first load;

said two independently reeved hoisting systems including a lower load block assembly suspended from said frame, the lower load block assembly having an upper block sheave assembly associated with one of the independently reeved hoisting systems and a lower block sheave assembly associated with the other independently reeved hoisting system, said upper and lower block sheave assemblies being independently supported from each other, and in engagement with said hook; and each independently reeved hoisting system includes an independent take-up means for extending and retracting said system.

12. The crane of claim 11 wherein each independently reeved hoisting system further includes:

an upper sheave assembly;

at least two ropes reeved on said upper sheave and one of said block sheave assemblies;

said take-up means having one of the ends of each rope attached to said take-up means; and an equalizer bar.

13. The crane of claim 12 wherein each take-up means comprises a hoist drum having said ropes wound thereon with one end of each of said ropes attached to the drum.

14. The crane of claim 13 wherein a first drum rotation assembly is associated with both of said take-up means.

15. The crane of claim 14 wherein said first drum rotation assembly comprises:

a first brake, a first hoist gearbox, and a first drum gearbox;

the first drum rotation assembly being mounted on said frame and associated with one end of each of said drums;

the first drum gearbox having power transmitted to it from said first hoist gearbox; and the first drum gearbox being provided with means for rotating said drums simultaneously or independently of one another, whereby if one of said drums becomes inoperative, the other drum will be rotated by the first drum gearbox.

16. The crane of claim 15 wherein a second drum rotation assembly is associated with both of said take-up means.

17. The crane of claim 16 wherein said second drum rotation assembly comprises:

a second brake, a second hoist gearbox, and a second drum gearbox;

the second drum rotation assembly being mounted on said frame and is associated with the ends of said drums which are opposite to the ends which said first rotation assembly is associated;

the second drum gearbox having power transmitted to it from said second hoist gearbox; and the second drum gearbox being provided with means for rotating said drums simultaneously or independently of one another, whereby if one of said drums becomes inoperative, the other drum will be rotated by the second drum gearbox.

18. The crane of claim 17 wherein said first and second brakes are associated with said first and second hoist gearboxes.

19. The crane of claim 12 wherein:

the equalizer bar of each independent sheave system is pivotably mounted upon a common equalizer bar which is pivotably mounted on the frame.

20. The crane of claim 11 wherein the dual element hook comprises:

a first hook means having a first shaft mounted on it;

a second hook means having a second shaft mounted on it;

the first shaft being fixedly secured to one of said independent sheave systems;

the second shaft being fixedly secured to the other independent sheave system; and a longitudinal axes of said first and second shafts coinciding with one another.

21. The crane of claim 20 wherein said first hook means is comprised of a lifting eye and said second hook means is comprised of a sister hook.

22. The crane of claim 21 wherein said dual element hook is provided with means for connecting the first and second hook means comprising:

a sister hook extension means which is associated with the sister hook; and a connection member for connecting said sister hook extension means and said lifting eye.

23. The crane of claim 22 wherein:

the sister hook extension means is comprised of two plate members which are fixedly secured to the sister hook, thus forming a space between the two plate members;

the connection member is comprised of a bushing;

the lifting eye is disposed below the sister hook in the space between the two plate members; and the bushing passes through the two plate members and the lifting eye.

* * * * *